US010770807B2

(12) United States Patent
Smith

(10) Patent No.: US 10,770,807 B2
(45) Date of Patent: Sep. 8, 2020

(54) ELECTRICAL RECEPTACLE FOR COAXIAL CABLE

(71) Applicant: Amphenol Corporation, Wallingford, CT (US)

(72) Inventor: James T. Smith, Portland, OR (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 16/244,976

(22) Filed: Jan. 10, 2019

(65) Prior Publication Data

US 2020/0227841 A1 Jul. 16, 2020

(51) Int. Cl.

| | |
|---|---|
| ***H01R 9/05*** | (2006.01) |
| ***H01R 24/50*** | (2011.01) |
| ***H01R 12/72*** | (2011.01) |
| ***H01R 24/54*** | (2011.01) |
| ***H01R 103/00*** | (2006.01) |

(52) U.S. Cl.

CPC ..... *H01R 9/0515* (2013.01); *H01R 9/0527* (2013.01); *H01R 12/721* (2013.01); *H01R 24/50* (2013.01); *H01R 24/54* (2013.01); *H01R 2103/00* (2013.01)

(58) Field of Classification Search

CPC .. H01R 2103/00; H01R 24/40; H01R 13/622; H01R 9/0524; H01R 9/05; H01R 9/0521; H01R 24/564; H01R 13/5202; H01R 13/6584; H01R 24/38; H01R 9/0527; H01R 13/65802; H01R 13/6581; H01R 9/0512; H01R 9/0518; H01R 9/0503; H01R 9/032; H01R 9/0515

See application file for complete search history.

(56) References Cited

U.S. PATENT DOCUMENTS 3,340,495 A * 9/1967 Weinschel ..... H01P 1/045 439/578
4,035,054 A * 7/1977 Lattanzi ..... H01R 24/44 439/578

(Continued)

FOREIGN PATENT DOCUMENTS

DE 4410072 3/1993
DE 102011086294 5/2013

(Continued)

*Primary Examiner* — James Harvey
*Assistant Examiner* — Matthew T Dzierzynski
(74) *Attorney, Agent, or Firm* — Blank Rome LLP

(57) ABSTRACT

An electrical receptacle that has a conductive body and a dielectric assembly received in the conductive body. The dielectric assembly has an entry dielectric portion, a distal support dielectric portion opposite the entry dielectric portion, and a reduced-diameter dielectric portion therebetween. An air region is defined between the inner surface of the conductive body and the reduced-diameter dielectric portion. An outer conductor is coupled to the conductive body and receives at least part of the entry dielectric portion. An inner contact is received in the dielectric assembly and has a mating interface end for receiving a corresponding mating contact, a termination end for coupling to a printed circuit board or adapter contact, and an inner through bore therebetween.

25 Claims, 5 Drawing Sheets

(56) References Cited

U.S. PATENT DOCUMENTS 4,125,308 A * 11/1978 Schilling ..... H01P 5/085 333/260
4,227,765 A 10/1980 Neumann et al.
4,684,200 A * 8/1987 Capp ..... H01R 24/50 439/387
4,721,481 A * 1/1988 Grellmann ..... H01R 24/52 439/551
4,952,174 A * 8/1990 Sucht ..... H01R 9/05 439/584
4,990,105 A * 2/1991 Karlovich ..... H01R 9/0518 439/578
5,037,328 A * 8/1991 Karlovich ..... H01R 9/0518 439/578
5,217,391 A * 6/1993 Fisher, Jr. ..... H01R 24/44 439/578
5,329,262 A * 7/1994 Fisher, Jr. ..... H01R 13/6315 333/260
5,670,744 A 9/1997 Ritchey
5,909,063 A 6/1999 Silliman et al.
6,099,322 A 8/2000 Beloritsky et al.
6,123,581 A * 9/2000 Stabile ..... H01R 24/44 439/578
6,210,221 B1 * 4/2001 Maury ..... H01R 9/0521 439/578
6,257,912 B1 7/2001 Boillot et al.
6,390,829 B1 5/2002 Rademacher
6,811,447 B2 11/2004 Pfister et al.
6,935,866 B2 8/2005 Kerekes et al.
7,309,255 B2 * 12/2007 Rodrigues ..... H01R 9/0524 439/578
7,500,855 B2 3/2009 Kari
7,762,854 B1 7/2010 Peng
7,892,028 B2 2/2011 Wu
7,946,854 B2 5/2011 Weidner et al.
7,985,076 B2 7/2011 Zuinen et al.
8,475,204 B2 * 7/2013 Blasick ..... H01R 24/44 439/578
8,827,743 B1 9/2014 Maury
9,017,102 B2 * 4/2015 Natoli ..... H01R 9/0524 439/578
9,065,185 B2 6/2015 Magnezi et al.
9,124,010 B2 * 9/2015 Eriksen ..... H01R 9/0524
9,136,655 B2 9/2015 Moon et al.
9,590,287 B2 * 3/2017 Burris ..... H01P 1/266
9,793,651 B2 * 10/2017 An ..... H01R 24/40
10,297,960 B2 * 5/2019 Urtz, Jr. ..... H01R 24/542

FOREIGN PATENT DOCUMENTS

FR 2950488 3/2011
JP 2014082155 5/2014
WO WO 09114225 9/2009

* cited by examiner

ELECTRICAL RECEPTACLE FOR COAXIAL CABLE

FIELD OF INVENTION

The present invention relates to an electrical receptacle for coaxial cable. The receptacle may be a hardline connector used in CATV networks, for example, without the need for a seizure mechanism to establish an electrical connection.

BACKGROUND

A radio frequency (RF) connector is an electrical connector designed to work at radio frequencies in the multi-megahertz range. Typically, RF connectors are used in a variety of applications, such as wireless telecommunications applications, including WiFi, CATV networks, PCS, radio, computer networks, test instruments and antenna devices.

CATV networks allow for the delivery of video and data to consumers and businesses. The network is typically HFC (hybrid fiber coaxial) and at least some portion for delivery to the premises is coaxial (copper-based). There are various devices in the networks, such as nodes, amplifiers, splitters, and other hardware known in the art that require connecting RF coaxial cables and connectors. There are two coaxial cable categories commonly used, i.e. flexible and hardline. Hardline connectors are typically used for longer runs on poles or for underground applications. These connectors typically interface with devices through a connector called a "KS Pin," a "⅝-24," or a "Stinger" connector because they feature a ⅝"-24 threaded coupling and have a protruding pin.

A limitation in current hardware is the KS Pin and how it is terminated to a PCB within network devices, Most KS Pins are shipped with oversized pin lengths to adapt to different hardware environments. When connecting to a device, the KS Pin is trimmed using common cutting tools and a length guide on the device. As the connector is mated to the device and the threads are properly tightened, the trimmed center pin passes into the device and through a contacting device called a pin seizure mechanism. This is a simple metal stub or block attached to the PCB with a through hole for the pin and a perpendicular threaded hole to accept a seizure screw. The screw is preassembled in the stub and the user tightens to a specified torque to clamp down on the pin. The clamping force creates the electrical connection.

The seizure mechanism is inherently poor at a low-loss transmission of RF, especially at higher frequencies. As result, as network frequencies increased, e.g. between 1200 and 1800 MHz, the connection provided by the seizure mechanism is a barrier to effective transmission. Further, the trimmed KS Pin itself provides connection challenges. First, the variable pin length can cause electrical or mechanical issues if it is not trimmed properly. If the pin is too long, it acts similarly to an RF antenna, increasing loss, and can contact another device component, causing mechanical damage. In addition, the pin is often trimmed with a common cable cutter, which can generate a chisel-like tip to the pin that can damage mating contacts.

There is a need in the market for a connector that can deliver faster data and improve video content with more choice and higher resolution. Accordingly, there is a need for a device that more effectively terminates the industry-standard KS Pin to a printed circuit board ("PCB") internal to a network device.

SUMMARY OF THE INVENTION

Accordingly, the present invention may provide an electrical receptacle that comprises a conductive body with an inner surface defining an inner receiving area and a dielectric assembly received in the inner receiving area of the conductive body. The dielectric assembly may comprise an entry dielectric portion, a distal support dielectric portion opposite the entry dielectric portion, and a reduced-diameter dielectric portion therebetween. An air region may be defined between the inner surface of the conductive body and the reduced-diameter dielectric portion of the dielectric assembly. An outer conductor may be coupled to the conductive body and receive at least part of the entry dielectric portion. An inner contact of the receptacle may have a mating interface end for receiving a corresponding mating contact, a termination end for coupling to a printed circuit board or adapter contact, and an inner through bore therebetween. The mating interface end may be received in the reduced-diameter dielectric portion. The dielectric assembly positions the inner contact along a central longitudinal axis of the conductive body.

In some embodiments the entry dielectric portion includes an inner ramped surface for guiding the mating contact into the mating interface end of the inner contacts; the distal support dielectric portion includes a radial flange that extends to the inner surface of the conductive body; the entry dielectric portion includes another radial flange that extends to the inner surface of the conductive body; the radial flange includes a secondary air region; the reduced-diameter portion is a sleeve configured to fit over the mating interface end of the inner contact; the air region is more than half of the inner receiving area of the conductive body; the termination end of the inner contact has an increased-diameter portion for engaging the printed circuit board; the termination end of the inner contact is elongated and receives the adaptor contact; each portion of the dielectric assembly is a separate piece; the portions of the dielectric assembly are formed of at least two pieces; and/or the at least two pieces are two identical half pieces.

In other embodiments, an outer surface of the conductive body includes one or more longitudinal slots configured to receive an edge of the printed circuit board; the outer conductor includes a grounding portion and a retaining portion, the retaining portion may be coupled to the conductive body such that the grounding portion extends outside of the conductive body; and/or the mating contact is a KS Pin.

The present invention may also provide as electrical receptacle that comprises a conductive body with an inner surface defining an inner receiving area and a dielectric assembly received in the inner receiving area of the conductive body. The dielectric assembly may comprise an entry dielectric portion, a distal support dielectric portion opposite the entry dielectric portion, and a reduced-diameter dielectric portion therebetween. An air region is defined between the inner surface of the conductive body and the reduced-diameter dielectric portion of the dielectric assembly. The air region is at least half of the inner receiving area of the conductive body. An outer conductor is coupled to the conductive body and receives at least part of the entry dielectric portion. An inner contact of the receptacle has a mating interface end for receiving a corresponding mating contact, a solder end for engaging a printed circuit board, and an inner through bore therebetween, the mating interface end being received in the reduced-diameter dielectric portion. The dielectric assembly positions the inner contact along a central longitudinal axis of the conductive body.

In certain embodiments, the entry dielectric portion includes an inner ramped surface for guiding the mating contact into the mating interface end of the inner contacts and the distal support dielectric portion includes a radial flange that extends to the inner surface of the conductive body; the entry dielectric portion includes another radial flange that extends to the inner surface of the conductive body and each radial flange has a secondary air region; the reduced-diameter portion is a sleeve configured to fit over the mating interface end of the inner contact; the solder end of the inner contact has an increased-diameter portion for solder engagement with the printed circuit board; the solder end includes a distal step portion; an outer surface of the conductive body includes one or more longitudinal slots configured to receive an edge of the printed circuit board; the outer conductor includes a grounding portion comprising spring fingers which extend outside of the conductive body and a retaining portion comprising a radial extension for engaging a retaining ring in the inner receiving area of conductive body; the portions of the dielectric assembly are formed of two or three pieces; and/or the mating contact is a KS Pin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1A:
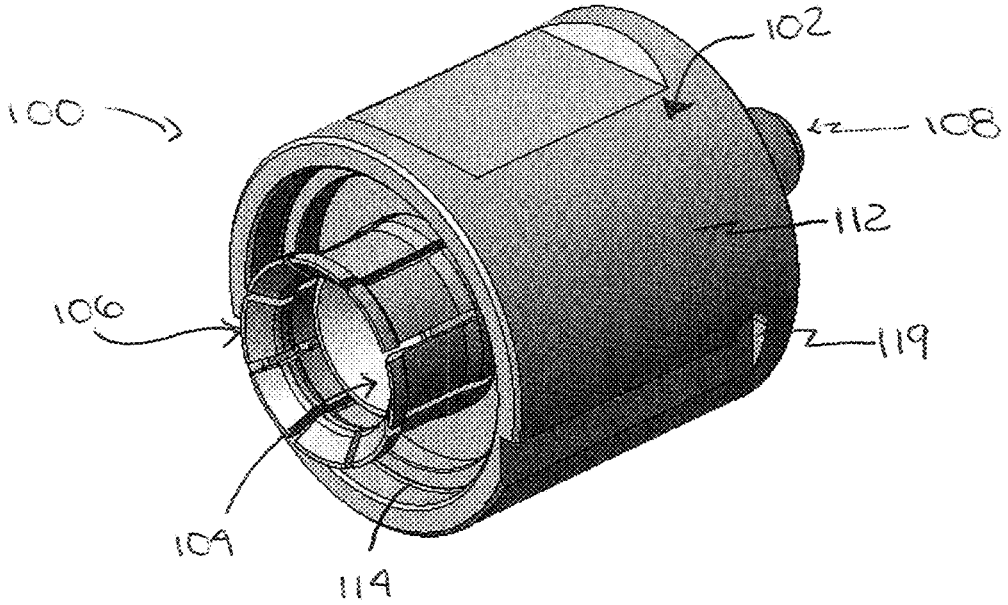
FIGS. 1A and 1B are front and rear perspective views, respectively, of an electrical receptacle according to an exemplary embodiment of the invention.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose. Several preferred embodiments of the invention are described for illustrative purposes, it being understood that the invention may be embodied in other forms not specifically shown in the drawings.

Referring to the figures, the present invention generally relates to an electrical receptacle 100 for coaxial cable that has a simplified design and improved performance, e.g. with regard to increased bandwidth, synergy with industry-standard protocols, new hardware, and higher frequency requirements, e.g. 1200 MHz up to 3 GHz, for a wider available channel bandwidth. The receptacle 100 of the present invention is configured to improve low-loss transmission of RF, especially at higher frequencies, optimize impedance (e.g. a 75 Ohm impedance), and minimize leakage of the RF signal.

Figure 1B:
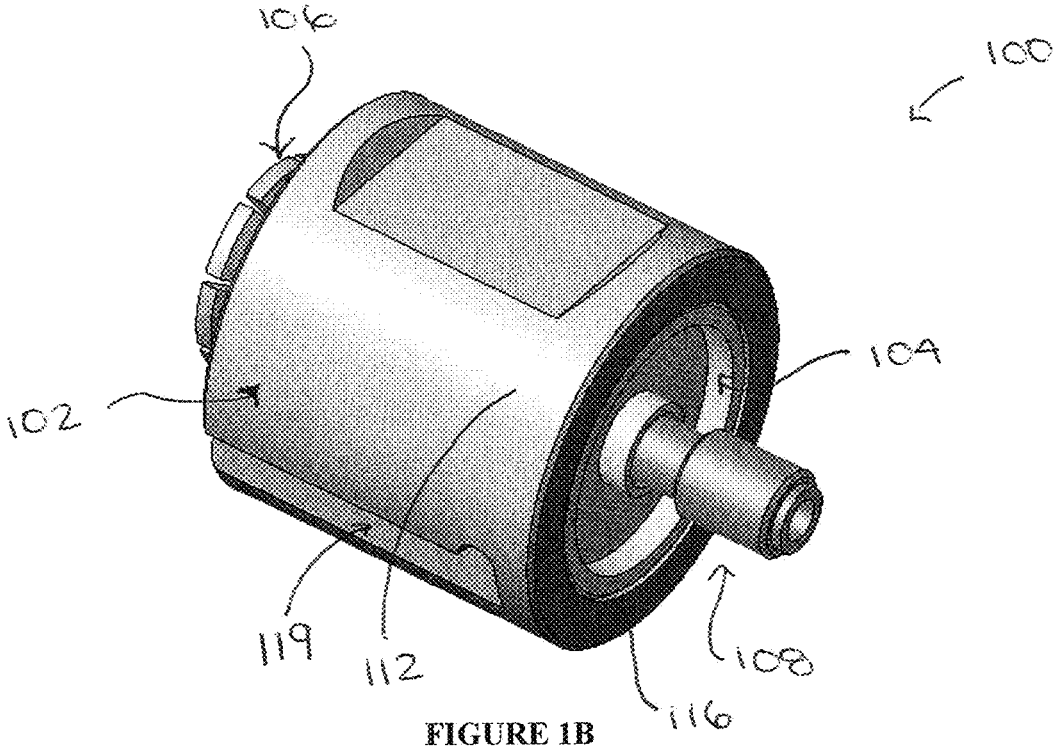
Figure 2A:
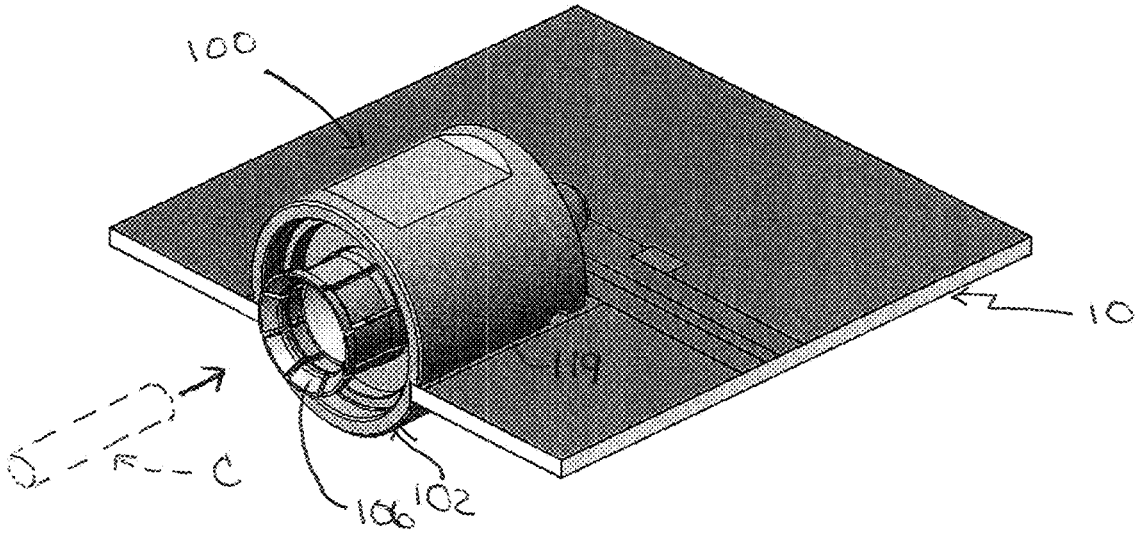
FIGS. 2A and 2B are front and rear perspective views, respectively, of the electrical receptacle illustrated in FIGS. 1A and 1B, showing the receptacle mounted to a printed circuit board.
Figure 2B:
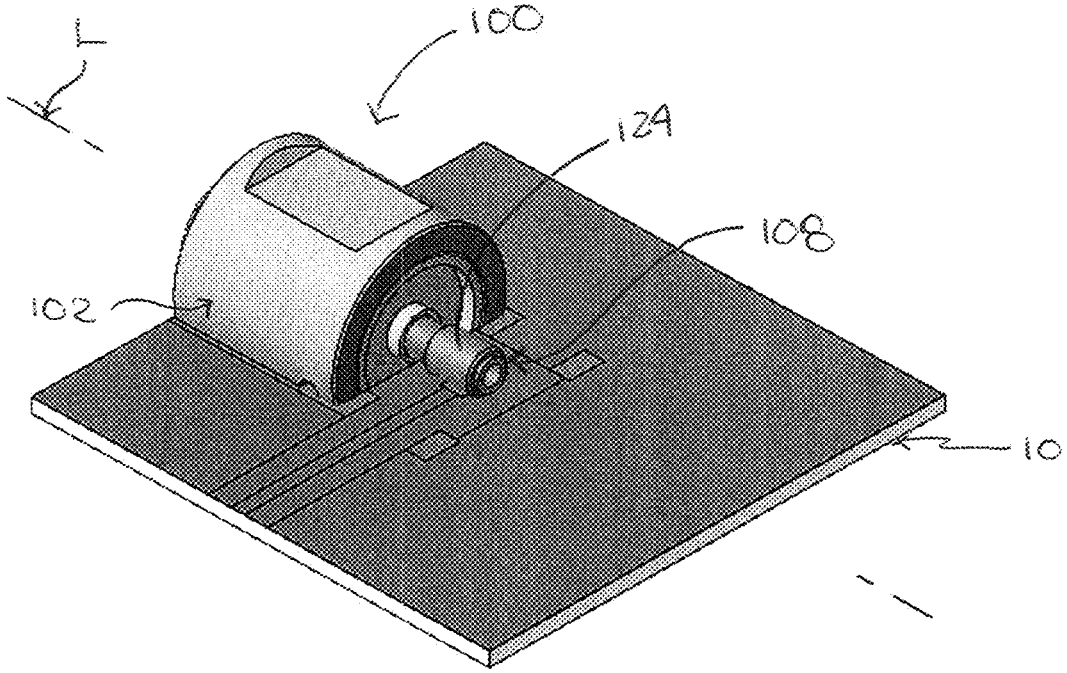
Figure 3:
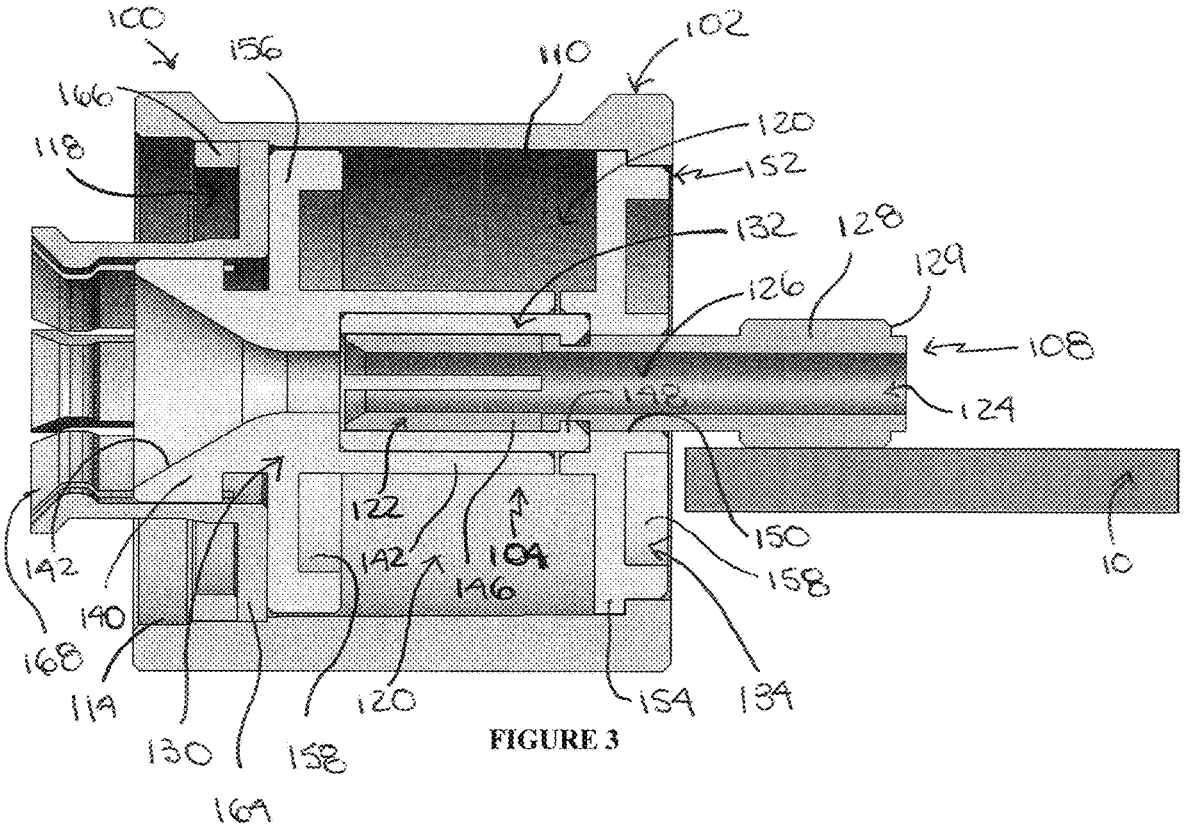
FIG. 3 is a cross-sectional view of the electrical receptacle illustrated in FIGS. 2A and 2B.

The receptacle 100 generally comprises a conductive body 102, a dielectric assembly 104 received in body 102, an outer conductor 106 coupled to body 102, and an inner contact 108 received in dielectric assembly 104. Body 102 may have inner and outer surfaces 110 and 112, front and rear open ends 114 and 116, and an inner receiving area 118 therebetween. One or more longitudinal slots 119 may be located on the body's outer surface 112, as seen in FIGS. 1A and 1B, to facilitate the mounting of receptacle 100 to a printed circuit board 10. In a preferred embodiment, the longitudinal slots 119 are located one either side of body 102 and are open at the front 114 to receive an edge of the printed circuit board 10, as seen in FIGS. 2A and 2B. An air region 120 may be defined between the body's inner surface 110 and dielectric assembly 104, as seen in FIG. 3. In a preferred embodiment, air region 120 takes up at least half or more than half of the inner receiving area 118 of body 102 to optimize impedance.

The dielectric assembly 104 is configured to facilitate assembly and captivation of the receptacle and configured to provide mechanical robustness and large air regions to the receptacle 100 for optimal impedance. Dielectric assembly 104 is received in inner receiving area 118 of conductive body 102 and supports inner contact 108 along a central longitudinal axis L of conductor body 104. A portion of dielectric assembly 104 may be received in outer conductor 106.

Inner contact 108 may comprise a mating interface end 122, such as a socket, for receiving a corresponding mating contact C (FIG. 2A), such as a KS Pin or Stinger, a termination end 124 for coupling to printed circuit board 10, and an inner through bore 126 therebetween through which the mating contact C may extend. Inner contact 108 is preferably captivated coaxially within conductive body 104 and supported by dielectric assembly 104 to achieve optimized mechanical and electrical function of receptacle 100. Through bore 126 allows mating contact C to extend all the way through inner contact 108, even if mating contact C is not trimmed properly. This prevents mechanical damage to receptacle 100 that could be caused by a relatively long mating contact. Termination end 124 may be a solder end with an increased-diameter part 128 for a more robust solder attachment to printed circuit board 10, as seen in FIG. 3. Termination end 124 may also have a step 129 at is most distal end and adjacent to part 128 for preventing solder migration into through bore for 126, and possible interference with the mating contact C.

Figure 4:
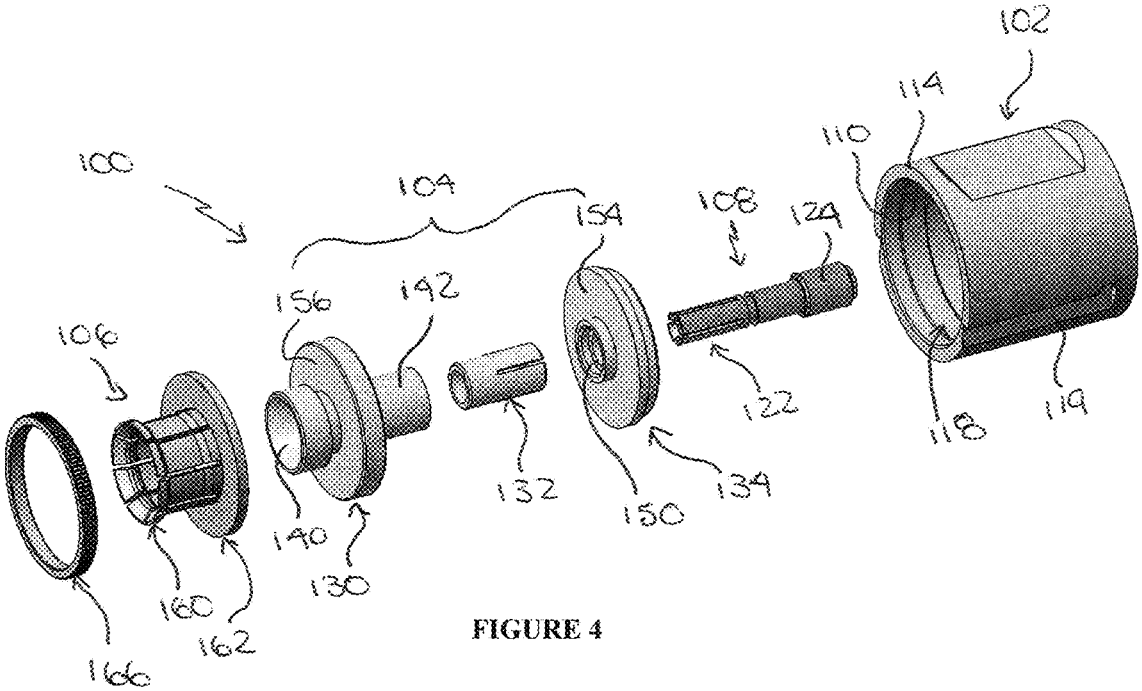
FIG. 4 is an exploded view of the electrical receptacle illustrated in FIGS. 1A and 1B.

As best seen in FIGS. 3 and 4, dielectric assembly 104 may comprise an entry dielectric portion 130, a distal support dielectric portion 134 opposite entry dielectric portion 130, and a reduced-diameter dielectric portion 132 therebetween. The portions 130, 132, and 134 of dielectric assembly 104 may be separate pieces, as seen in FIG. 4, which are assembled around inner contact 108 to position contact 108 within conductive body 104 along its central longitudinal axis L, as seen in FIGS. 2B and 3.

Entry dielectric portion 130 may comprise a lead-in geometry at a front end 140 and a generally cylindrical main body 142. The front end 140 includes an inner ramped surface 144 configured to receive and guide the mating contact C, such as a KS Pin or Stinger, into receptacle 100 for engagement with a mating interface end 122 of inner contact 108. The front end 140 may also fit inside of outer conductor 106.

Reduced-diameter portion 132 may be a sleeve 146 sized to both closely cover the inner contact's mating interface end 122 and be received within main body 142 of entry dielectric portion 130. The sleeve 146 may have an inner lip 148 at is distal end for engaging the inner contact 108, such as via a snap-engagement. Air region 120 is preferably defined between reduced-diameter portion 132 and the inner surface 110 of conductive body 102.

Distal support dielectric portion 134 may comprise a center bore 150, through which inner contact 108 extends, and a support member 152 configured to provide support and mechanical strength to receptacle 100. In a preferred embodiment, support member 152 is a radial flange 154 extending radially from center bore 150 to the inner surface 110 of conductive body 104. The main body 142 of entry dielectric portion 130 may also include a support member, such as another radial flange 156, positioned behind front end 140. Both flanges 154 and 156 may include a secondary air region 158 defined therein.

Outer conductor 106 generally comprises a grounding portion 160 and a retaining portion 162. Retaining portion 162 may be configured to engage conductive body 102. In a preferred embodiment, retaining portion 162 is an end wall 164 received inside the front end 114 of conductive body 102 that may cooperate with a retaining ring 166 to couple outer conductor 106 to body 102. Alternatively, end wall 164 may engage a corresponding groove in the body's inner surface 110. Grounding portion 160 may comprises a plurality of spring fingers 168 that extend outside of the front end 114 of body 102 for grounding contact with the system's housing. The housing may be, for example, a common ground that is part of the transmission line carrying the RF ground signal from the mating KS Pin cable connector through the KS Pin port integrated in the node housing.

Figure 5:
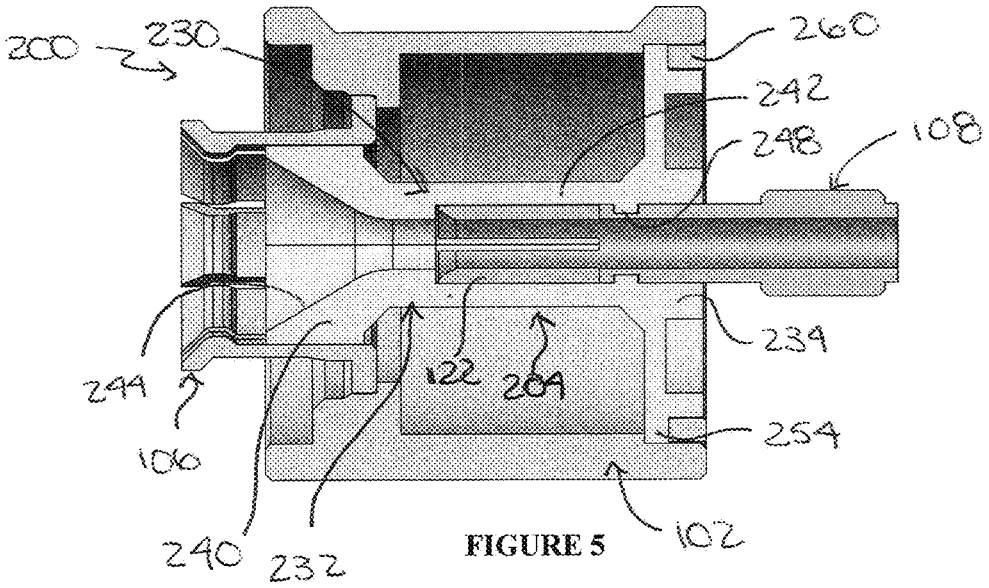
FIG. 5 is a cross-sectional view of an electrical receptacle in accordance with another exemplary embodiment of the present invention.
Figure 6:
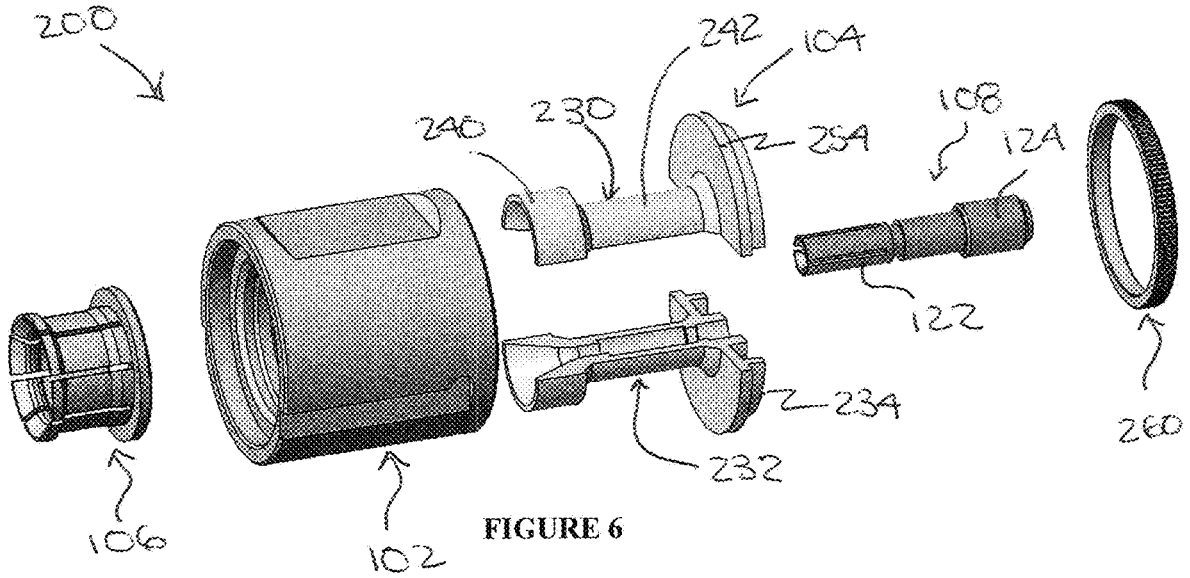
FIG. 6 is an exploded view of the electrical receptacle illustrated in FIG. 5.

FIGS. 5 and 6 illustrated another exemplary embodiment of the present invention in which a receptacle 200 is substantially the same as receptacle 100 described above, except its dielectric assembly 204 is formed of only two portions 230 and 232. In a preferred embodiment, the two portions are identical half pieces and may be injection molded, for example. When the two portions 230 and 232 are assembled for supporting inner contact 108, dielectric assembly 204 comprises a front entry end 240, a distal support end 234, and a reduced-diameter cylindrical main body 242, therebetween. Front end 240 may have lead-in geometry, such as an inner ramped surface 244 and distal end 234 may have a radial flange 254, like in receptacle 100. Main body 242 is sized to closely receive the mating interface end 122 of inner contact 108 and may have an inner lip 248 configured to engage inner contact 108, similar to receptacle 100. A retaining ring 260 may be provided to secure the two portions 230 and 232 of dielectric assembly 204 together.

Figure 7:
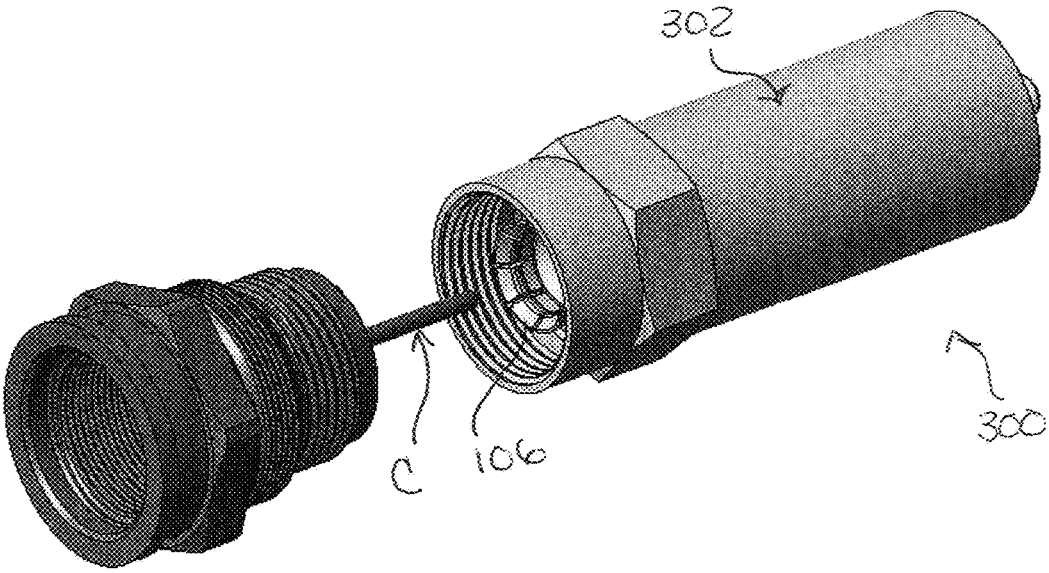
FIG. 7 is an exploded view of an electrical receptacle in accordance with yet another exemplary embodiment of the present invention.
Figure 8:
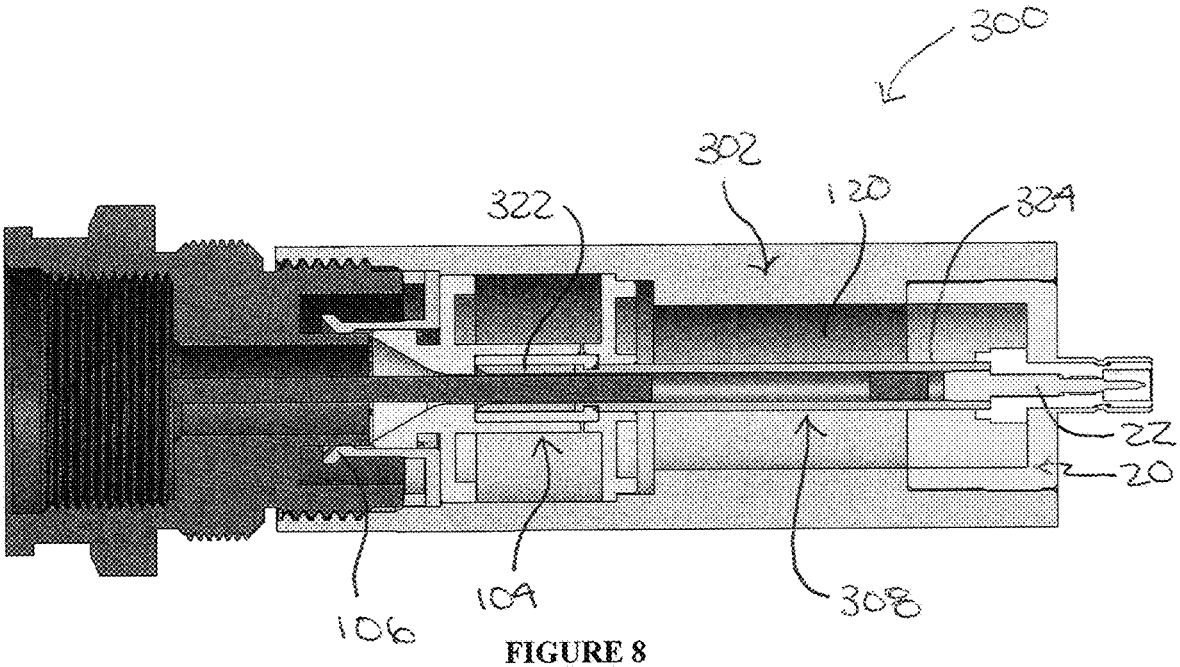
FIG. 8 is a cross-sectional view of the electrical receptacle illustrated in FIG. 7.

FIGS. 7 and 8 illustrate yet another embodiment of the present invention in which a receptacle 300 is similar to receptacle 100, except that it is configured to engage an adapter 20 instead of a printed circuit board. The adapter may be used when the printed circuit board in the node, for example, is not conveniently positioned by the KS Pin port. The node includes the printed circuit board to process the signal entering or exiting the node. In some cases, the signal is sent to the printed circuit board with a cable assembly routed to the printed circuit board position in the node. The adapter may convert the KS Pin interface into a common high-performance RF interface, such as "SMB" or "MCX". This interface adapts efficiently to a small flexible cable assembly for routing within the node.

The conductive body 302 and inner contact 308 of receptacle 300 are elongated to accommodate the maximum length of the mating contact C. Inner contact 308 has a mating interface end 322 supported by dielectric assembly 104, like in receptacle 100, and a termination end 324. Termination end 324 of inner contact 308 is configured to engage a contact 22 of the adaptor 20, as seen in FIG. 8.

The foregoing description and drawings should be considered as illustrative only of the principles of the invention. The invention is not intended to be limited by the preferred embodiment and may be implemented in a variety of ways that will be clear to one of ordinary skill in the art. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An electrical receptacle, comprising:

a conductive body with an inner surface defining an inner receiving area;

a dielectric assembly received in the inner receiving area of the conductive body, the dielectric assembly comprising an entry dielectric portion, a distal support dielectric portion opposite the entry dielectric portion, and a reduced-diameter dielectric portion therebetween;

an air region defined between the inner surface of the conductive body and the reduced-diameter dielectric portion of the dielectric assembly;

an outer conductor coupled to the conductive body and receiving at least part of the entry dielectric portion; and an inner contact having a mating interface end for receiving a corresponding mating contact, a termination end for coupling to a printed circuit board or adapter contact, and an inner through bore therebetween, the mating interface end being received in the reduced-diameter dielectric portion, wherein the dielectric assembly positions the inner contact along a central longitudinal axis of the conductive body.

2. The electrical receptacle of claim 1, wherein the entry dielectric portion includes an inner ramped surface for guiding the mating contact into the mating interface end of the inner contacts.

3. The electrical receptacle of claim 1, wherein the distal support dielectric portion includes a radial flange that extends to the inner surface of the conductive body.

4. The electrical receptacle of claim 3, wherein the entry dielectric portion includes another radial flange that extends to the inner surface of the conductive body.

5. The electrical receptacle of claim 4, wherein one or both of the radial flanges includes a secondary air region.

6. The electrical receptacle of claim 1, wherein the reduced-diameter portion is a sleeve configured to fit over the mating interface end of the inner contact.

7. The electrical receptacle of claim 1, wherein the air region is more than half of the inner receiving area of the conductive body.

8. The electrical receptacle of claim 1, wherein the termination end of the inner contact has an increased-diameter portion for engaging the printed circuit board.

9. The electrical receptacle of claim 1, wherein the termination end of the inner contact is elongated and receives the adaptor contact.

10. The electrical receptacle of claim 1, wherein an outer surface of the conductive body includes one or more longitudinal slots configured to receive an edge of the printed circuit board.

11. The electrical receptacle of claim 1, wherein the outer conductor includes a grounding portion and a retaining portion, the retaining portion being coupled to the conductive body such that the grounding portion extends outside of the conductive body.

12. The electrical receptacle of claim 1, wherein the portions of the dielectric assembly are formed of at least two pieces.

13. The electrical receptacle of claim 12, wherein the at least two pieces are two identical half pieces.

14. The electrical receptacle of claim 1, wherein each portion of the dielectric assembly is a separate piece.

15. The electrical receptacle of claim 1, wherein the mating contact is a KS Pin.

16. An electrical receptacle, comprising, a conductive body with an inner surface defining an inner receiving area;

a dielectric assembly received in the inner receiving area of the conductive body, the dielectric assembly comprising an entry dielectric portion, a distal support dielectric portion opposite the entry dielectric portion, and a reduced-diameter dielectric portion therebetween;

an air region defined between the inner surface of the conductive body and the reduced-diameter dielectric portion of the dielectric assembly, the air region being at least half of the inner receiving area of the conductive body;

an outer conductor coupled to the conductive body and receiving at least part of the entry dielectric portion; and an inner contact having a mating interface end for receiving a corresponding mating contact, a solder end for engaging a printed circuit board, and an inner through bore therebetween, the mating interface end being received in the reduced-diameter dielectric portion, wherein the dielectric assembly positions the inner contact along a central longitudinal axis of the conductive body.

17. The electrical receptacle of claim 16, wherein the entry dielectric portion includes an inner ramped surface for guiding the mating contact into the mating interface end of the inner contacts; and the distal support dielectric portion includes a radial flange that extends to the inner surface of the conductive body.

18. The electrical receptacle of claim 17, wherein the entry dielectric portion includes another radial flange that extends to the inner surface of the conductive body; and each radial flange has a secondary air region.

19. The electrical receptacle of claim 17, wherein the reduced-diameter portion is a sleeve configured to tit over the mating interface end of the inner contact.

20. The electrical receptacle of claim 16, wherein the solder end of the inner contact has an increased-diameter portion for solder engagement with the printed circuit board.

21. The electrical receptacle of claim 20, wherein the solder end includes a distal step portion.

22. The electrical receptacle of claim 16, wherein an outer surface of the conductive body includes one or more longitudinal slots configured to receive an edge of the printed circuit board.

23. The electrical receptacle of claim 16, wherein the outer conductor includes a grounding portion comprising spring fingers which extend outside of the conductive body and a retaining portion comprising a radial extension for engaging a retaining ring in the inner receiving area of conductive body.

24. The electrical receptacle of claim 16, wherein the portions of the dielectric assembly are formed of two or three pieces.

25. The electrical receptacle of claim 16, wherein the mating contact is a KS Pin.

* * * * *